US010947654B2

(12) United States Patent
Imaizumi

(10) Patent No.: US 10,947,654 B2
(45) Date of Patent: Mar. 16, 2021

(54) SEWING MACHINE

(71) Applicant: BROTHER KOGYO KABUSHIKI KAISHA, Nagoya (JP)

(72) Inventor: Kazutaka Imaizumi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 85 days.

(21) Appl. No.: 16/527,235

(22) Filed: Jul. 31, 2019

(65) Prior Publication Data

US 2020/0048807 A1 Feb. 13, 2020

(30) Foreign Application Priority Data

Aug. 9, 2018 (JP) ..... JP2018-150191

(51) Int. Cl.

| | |
|---|---|
| ***D05B 79/00*** | (2006.01) |
| ***D05B 19/12*** | (2006.01) |
| ***D05B 19/08*** | (2006.01) |
| ***D05C 5/02*** | (2006.01) |
| ***D05B 35/12*** | (2006.01) |
| ***D05B 19/10*** | (2006.01) |

(52) U.S. Cl.

CPC ..... *D05B 19/12* (2013.01); *D05B 19/08* (2013.01); *D05B 19/10* (2013.01); *D05B 35/12* (2013.01); *D05B 79/00* (2013.01); *D05C 5/02* (2013.01)

(58) Field of Classification Search

CPC ..... D05B 19/081; D05B 19/10; D05B 19/12; D05B 35/12; D05B 79/00; D05C 5/02

USPC ..... 700/136–138

See application file for complete search history.

(56) References Cited

U.S. PATENT DOCUMENTS

| | | | | |
|---|---|---|---|---|
| 6,161,491 | A * | 12/2000 | Takenoya | D05B 19/02 112/102.5 |
| 2011/0226170 | A1* | 9/2011 | Tokura | D05C 13/02 112/470.05 |
| 2014/0000498 | A1* | 1/2014 | Yamanashi | D05C 5/02 112/102.5 |
| 2014/0182499 | A1* | 7/2014 | Matsushima | D05B 19/12 112/470.04 |
| 2015/0259841 | A1* | 9/2015 | Ihira | D05B 81/00 112/102.5 |

FOREIGN PATENT DOCUMENTS

JP H05-269278 A 10/1993

* cited by examiner

*Primary Examiner* — Nathan E Durham
(74) *Attorney, Agent, or Firm* — Oliff PLC

(57) ABSTRACT

A sewing machine includes a bed, a projector configured to project an image toward the bed onto at least a guarantee area, a storage medium, and a controller. The controller controls the projector to project the image toward the bed onto a maximum area. The controller determines, based on a position of the image projected onto the maximum area, first world coordinates representing, in a real space coordinate system, a rectangular area contained in the maximum area. The controller determines, based on the first world coordinates, second world coordinates representing, in the real space coordinate system, a target area containing at least the guarantee area. The controller stores the second world coordinates in the storage medium.

9 Claims, 8 Drawing Sheets

M1(M1x,M1y)
W1(W1x,W1y)
W2(W2x,W2y)
M2(M2x,M2y)
G1(G1x,G1y)
G2(G2x,G2y)
Q1(Q1x,Q1y)
Q2(Q2x,Q2y)
H1
Hh
Hw
S2
Q3(Q3x,Q3y)
Q4(Q4x,Q4y)
G3(G3x,G3y)
G4(G4x,G4y)
M
W
Q
G
S1
M3(M3x,M3y)
=W3(W3x,W3y)
M4(M4x,M4y)
=W4(W4x,W4y)
H2

M1(M1x,M1y)
W1(W1x,W1y)
Q
G
W2(W2x,W2y)
M2(M2x,M2y)
G1(G1x,G1y)
G2(G2x,G2y)
H1
Q1(Q1x,Q1y)
Q2(Q2x,Q2y)
Hw
M
W
Hh
Q3(Q3x,Q3y)
Q4(Q4x,Q4y)
G3(G3x,G3y)
G4(G4x,G4y)
M3(M3x,M3y)
=W3(W3x,W3y)
M4(M4x,M4y)
=W4(W4x,W4y)
H2
REAR
LEFT
RIGHT
FRONT
NEGATIVE
Y-AXIS
DIRECTION
NEGATIVE
POSITIVE
X-AXIS
DIRECTION
POSITIVE

SEWING MACHINE

CROSS-REFERENCE TO RELATED APPLICATION

This application claims priority from Japanese Patent Application No. 2018-150191 filed on Aug. 9, 2018, the content of which is incorporated herein by reference in its entirety.

TECHNICAL FIELD

One or more aspects of the disclosure relate to a sewing machine.

BACKGROUND

A known sewing machine includes a projector. The projector disposed inside an arm includes a light transmission display such as a liquid crystal display (LCD), and a light source behind the LCD. The LCD displays thereon an image indicating an embroidery pattern shape, stitch start and end positions, and a stitch height position. When the light source turns on, the image displayed on the LCD is projected onto a fabric on a surface of a bed.

The position of a maximum area onto which a projector can project an image may vary among sewing machines because of an assembling error of a projector and individual differences among projectors. On the other hand, when an area onto which a projector projects an image is specified, as a guarantee area, by the specifications of a sewing machine or the like, the guarantee area needs to be contained in the maximum area commonly in each sewing machine.

SUMMARY

According to an aspect of the disclosure, a sewing machine is configured to determine a target area containing a guarantee area while calibrating a projector. The projector is configured to project an image onto at least the guarantee area. An embroidery hoop for holding a workpiece may be moved relative to the target area.

According to an aspect of the disclosure, a sewing machine includes a bed, a projector configured to project an image toward the bed onto at least a guarantee area, a storage medium, and a controller. The controller is configured to control the projector to project the image toward the bed onto a maximum area. The controller is configured to determine, based on a position of the image projected onto the maximum area, first world coordinates representing, in a real space coordinate system, a rectangular area contained in the maximum area. The controller is configured to determine, based on the first world coordinates, second world coordinates representing, in the real space coordinate system, a target area containing at least the guarantee area. The controller is configured to store the second world coordinates in the storage medium.

The sewing machine according to the aspect of the disclosure determines the target area based on the second world coordinates stored in the storage medium.

DETAILED DESCRIPTION

Overview of Sewing Machine

Figure 1:
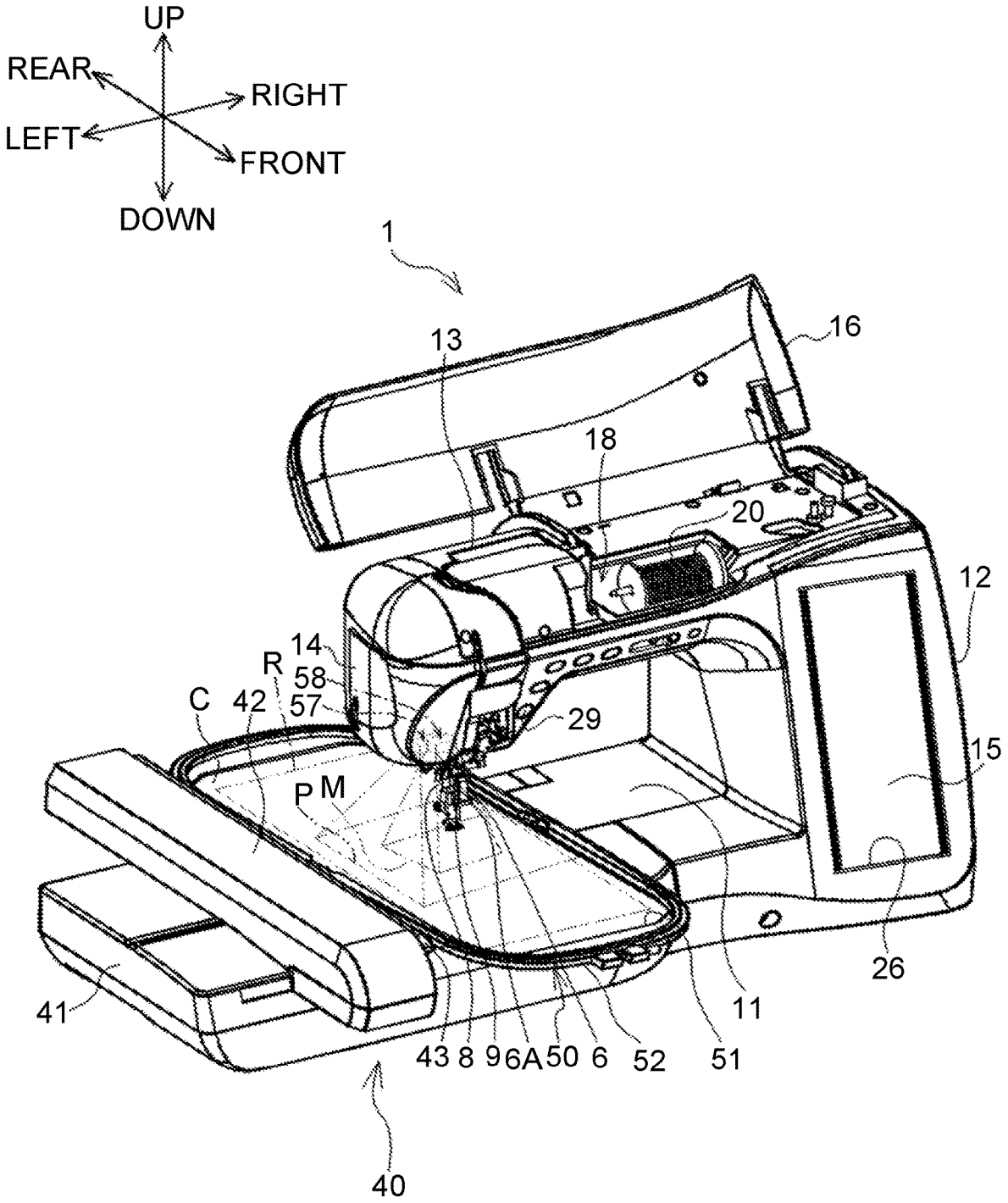
FIG. 1 is a perspective view of a sewing machine according to an embodiment of the disclosure.

An embodiment of the disclosure will be described with reference to the accompanying drawings. Referring to FIGS. 1 to 4, a physical structure of a sewing machine 1 including a moving unit 1 will be described. In the following description, directional terminology, such as "up/upper," "down/lower," "front," "rear," "left," "right" etc., as labeled in the drawings, may be used. An upper side, a lower side, a lower right side, an upper left side, a lower left side, and an upper right side of the page of FIG. 1 respectively correspond to an upper side, a lower side, a front side, a rear side, a left side, and a right side of the sewing machine 1 including a moving unit 40. A longitudinal direction of a bed 11 and a horizontal arm 13 corresponds to the left-right direction of the sewing machine 1. A side of the sewing machine 1 on which an upright arm 12 is disposed is the right side. A direction in which the upright arm 12 is elongated is an up-down direction of the sewing machine 1.

As shown in FIG. 1, the sewing machine 1 includes the bed 11, the upright arm 12, the horizontal arm 13, and a head 14. The bed 11 is a base portion of the sewing machine 1 and extends in the left-right direction. The upright arm 12 extends upward from a right end portion of the bed 11. The horizontal arm 13 extends leftward from an upper end of the upright arm 12 and faces the bed 11. The head 14 is connected to a left end portion of the horizontal arm 13.

Figure 2:
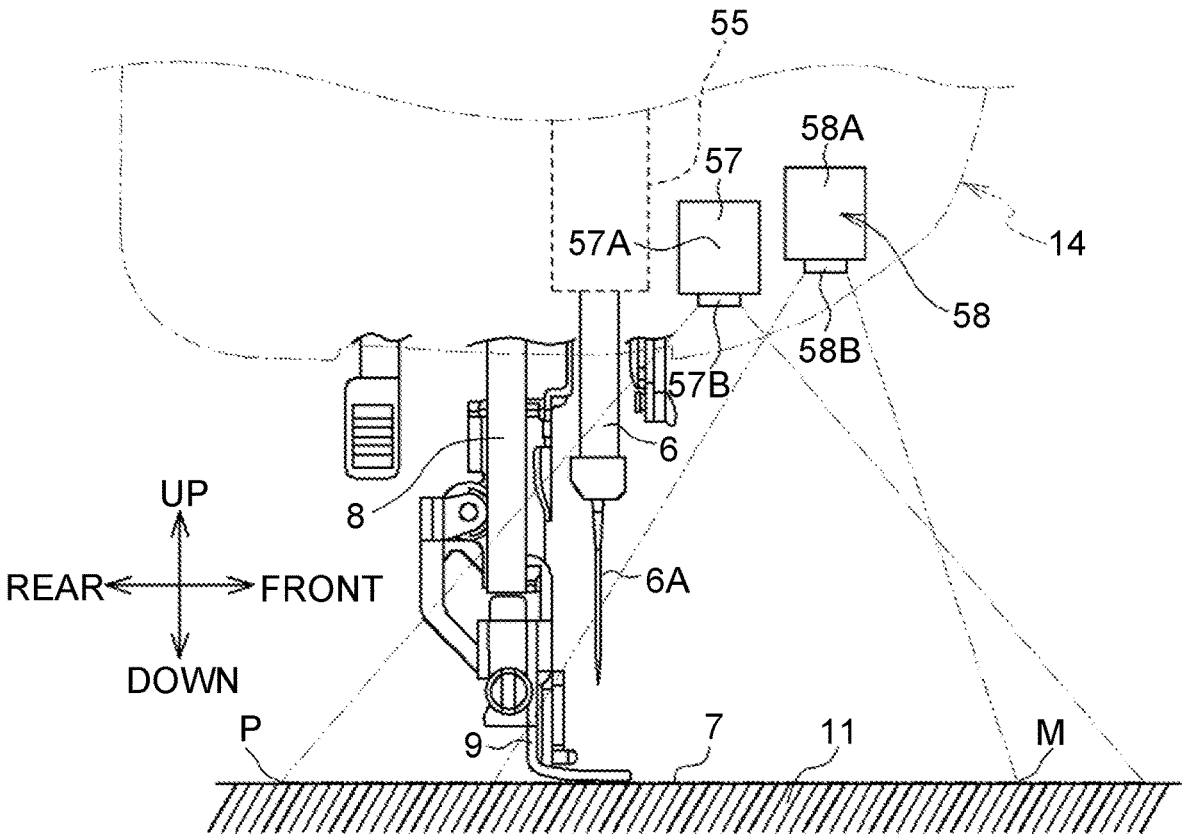
FIG. 2 is a diagram showing the structure of a lower end portion of a head of the sewing machine.
Figure 3:
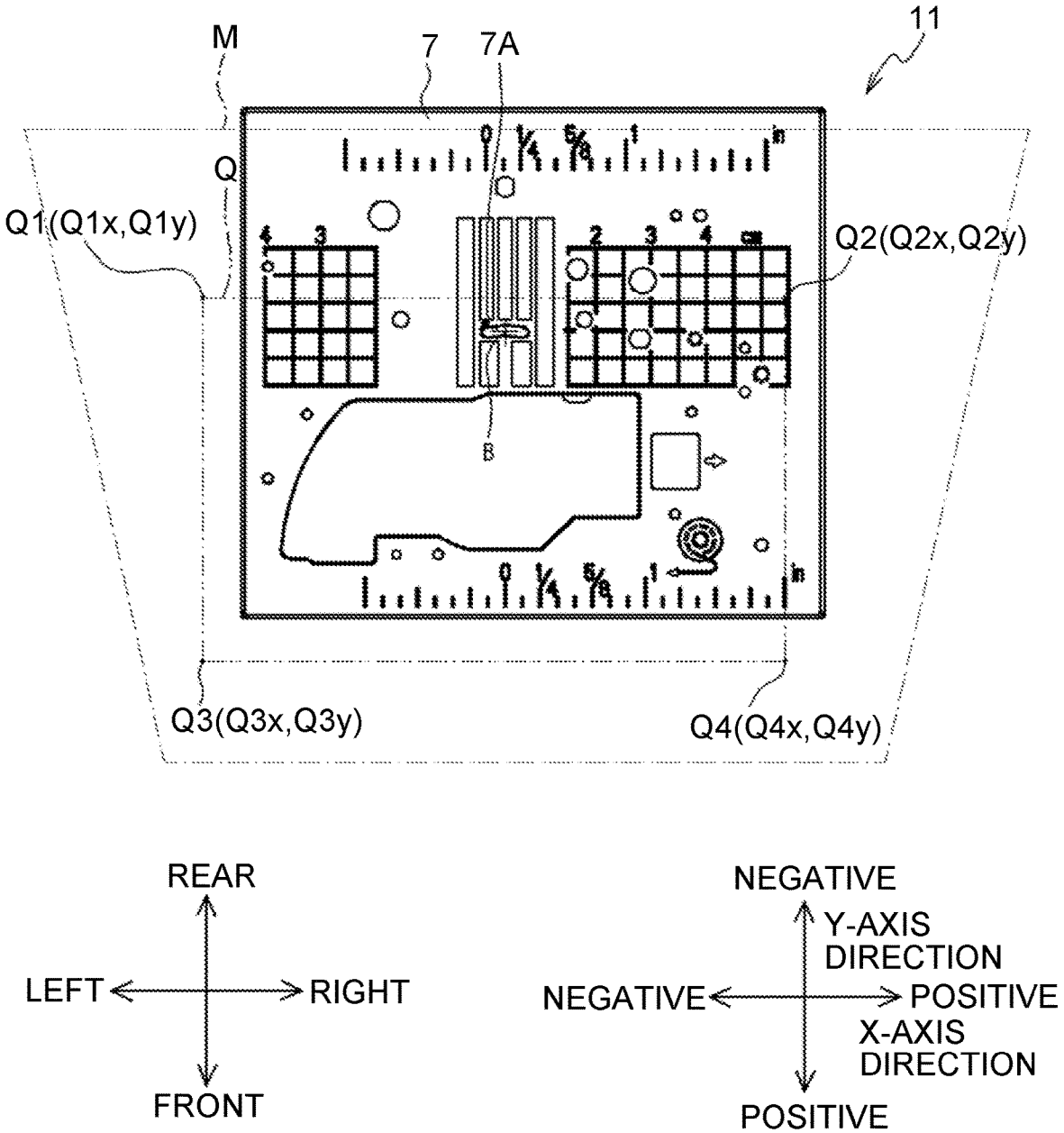
FIG. 3 is a plan view of a needle plate and its surroundings on a bed of the sewing machine.

As shown in FIGS. 2 and 3, the bed 3 includes a needle plate 7 at an upper surface thereof. As shown in FIG. 3, the needle plate 7 has a needle hole 7A configured to receive a needle 6A (refer to FIG. 2), which will be described below. The needle hole 7A is a slot extending in the left-right direction. The position of the needle hole 7A corresponds to a drop position of the needle 6A. Hereinafter, a needle drop point B is defined as a reference point where the needle drops. The needle drop point B is positioned at the center of the needle hole 7A in the left-right direction and the front-rear direction. The bed 11 includes therein a feed dog 24, a feed mechanism 23 (refer to FIG. 4) and a shuttle mechanism (not shown). The feed dog 24 is driven by the feed mechanism 23 to feed a workpiece C by a predetermined amount during normal sewing other than embroidery sewing. The shuttle mechanism causes an upper thread (not shown) to be entwined or intertwined with a lower thread (not shown) underneath the needle plate 7.

As shown in FIG. 1, a liquid crystal display (LCD) 15 is disposed at the front of the upright arm 12. The LCD 15 is configured to display an image including various items, such as commands, illustrations, settings, and messages. On the front surface of the LCD 15, a touch screen 26 is disposed to detect a pressed position thereof. The touch screen 26 is configured to detect a position thereof pressed by a user with his/her finger or a stylus (not shown). A controller 2 (refer to FIG. 4) of the sewing machine 1 determines, based on the position detected by the touch screen 26, an item selected on the displayed image. A user's operation of pressing the touch screen 26 may be hereinafter referred to as a "panel operation". A user is allowed to select a pattern to be sewn and a command to be executed, with a panel operation. A machine motor 33 (refer to FIG. 4) is disposed inside the upright arm 12.

As shown in FIG. 1, an openable cover 16 is disposed at an upper portion of the horizontal arm 13. FIG. 1 shows the cover 16 at an open position. A spool storage 18 is located below the cover 16 at a closed position (e.g., inside the horizontal arm 13). The spool storage 18 is configured to receive a spool 20 having the upper thread wound thereon. Inside the horizontal arm 13, a shaft 34 (refer to FIG. 4) extends in the left-right direction. The shaft 34 is driven to rotate by the machine motor 33 (refer to FIG. 4). Various switches, including a start/stop switch 29, are located at a lower left portion of the front surface of the horizontal arm 13. The start/stop switch 29 is used to input an instruction to start or stop sewing.

Figure 4:
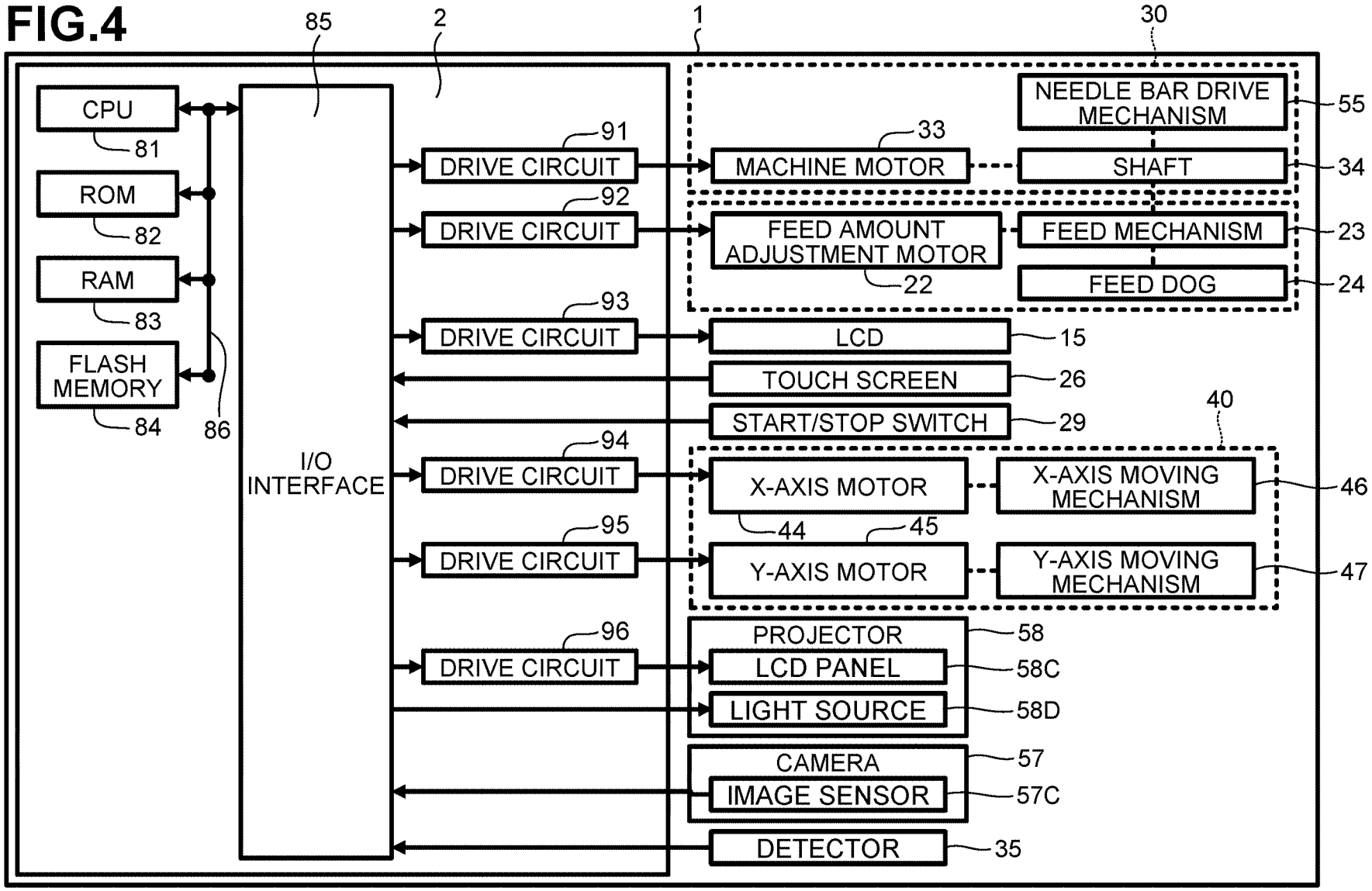
FIG. 4 is block diagram showing an electrical structure of the sewing machine.

As shown in FIG. 2, the head 14 includes a presser bar 8, a camera 57, a projector 58, and a sewing unit 30 (refer to FIG. 4). The sewing unit 30 includes a needle bar 6 and is configured to form stitches on a workpiece C (refer to FIG. 1) by moving the needle bar 6 up and down. The needle bar 6 is located above the needle hole 7A (refer to FIG. 3). The needle 6A is removably attached to a lower end of the needle bar 6. The sewing unit 30 further includes the shaft 34 (refer to FIG. 4) and a needle bar drive mechanism 55. The needle bar drive mechanism 55 is configured to drive the needle bar 6 in the up-down direction by the rotation of the shaft 34. A presser foot 9 is removably attached to a lower end of the presser bar 8. The presser foot 9 is configured to intermittently press the workpiece C down in association with the up-down movement of the needle bar 8.

As shown in FIG. 2, the projector 58 is configured to project an image toward the bed 11. The projector 58 may be a liquid crystal display (LCD) projector. The projector 58 includes a box-shaped casing 58A. The casing 58A is located in the head 14 and is fixed to a machine casing. A lens 58B is connected to a lower surface of the casing 58A. The casing 58A houses therein a liquid crystal display (LCD) panel 58C and a light source 58D which are shown in FIG. 4. The LCD panel 58C is configured to modulate the light from the light source 58D and form image light beams. The formed image light beams are emitted downward via the lens 58B. As shown in FIG. 2, the emitted image light beams are formed into an image on the upper surface of the bed 11. For example, when a workpiece C held by the embroidery hoop 50 to be described below is placed on the bed 11, the image beam is formed into an image on a workpiece C. As shown in FIG. 3, a maximum area onto which the projector 58 is able to project an image is referred to as a maximum area M.

The direction of the image light beams emitted from the projector 58 is slightly inclined rearward relative to a vertically downward direction. As a result, the maximum area M is a trapezoid having a front side and a rear side which are parallel to each other. The front side is less than the rear side.

As shown in FIG. 2, the camera 57 is configured to capture an image in a predetermined capture area P containing the maximum area M. The camera 57 includes a box-shaped casing 57A. The casing 57A is located in the head 14 and is fixed to the machine casing. A lens 57B is disposed on a lower surface of the casing 57A. The casing 57A houses therein an image sensor 57C shown in FIG. 4. The image sensor 57C detects incident light from the capture area P via the lens 57B, thereby capturing an image in the capture area P. For example, when the projector 58 projects an image on a workpiece C held by the embroidery hoop 50, the camera 57 captures the projected image.

As shown in FIG. 1, the moving unit 40 is detachably mounted on the bed 11 of the sewing machine 1. The moving unit 40 includes a holder 43 to which the embroidery hoop 50 is detachably attached. The moving unit 40 is configured to move the embroidery hoop 50 attached to the holder 43 by moving the holder 43 relative to the needle bar 6. A selected one of a plurality of embroidery hoops including the embroidery hoop 50 is mountable on the moving unit 40. Hoop members 51 and 52 of the embroidery hoop 50 hold therebetween a workpiece C (e.g. a fabric). The moving unit 40 includes a main unit 41 and a carriage 42. The carriage 42 includes the holder 43, a Y-axis moving mechanism 47 (refer to FIG. 4) and a Y-axis motor 45 (refer to FIG. 4). The holder 43 is disposed on a right side surface of the carriage 42. The embroidery hoop 50 is detachably attached to the holder 43 of the carriage 42. The Y-axis moving mechanism 47 moves the holder 43 in the front-rear direction (Y-axis direction). The Y-axis motor 45 (refer to FIG. 4) drives the Y-axis moving mechanism 47. The main unit 41 includes therein an X-axis moving mechanism 46 (refer to FIG. 4) and an X-axis motor 44 (refer to FIG. 4). The X-axis moving mechanism 46 moves the carriage 42 in the left-right direction (X-axis direction). The X-axis motor 44 drives the X-axis moving mechanism 46. During embroidery sewing using the embroidery hoop 50, the moving unit 40 is configured to move the embroidery hoop 50 attached to the holder 43 in the X-axis and Y-axis directions.

When the sewing machine 1 executes embroidery sewing using the embroidery hoop 50, the moving unit 40 moves the embroidery hoop 50 in the X-axis and Y-axis directions while the needle bar drive mechanism 55 and the shuttle mechanism (not shown) are driven. This allows for the needle 6A attached to the needle bar 6 to sew embroidery patterns into the workpiece C held by the embroidery hoop 50.

Electrical Structure

Referring to FIG. 4, an electrical structure of the sewing machine 1 will be described. The sewing machine 1 includes a CPU 81, a ROM 82, a RAM 83, a flash memory 84, and an input/output (I/O) interface 85. The CPU 81 is connected to the ROM 82, the RAM 83, the flash memory 84, and the I/O interface 85, via a bus 86.

The CPU 81 performs overall control of the sewing machine 1. The CPU 81 performs various calculations and processing relating to sewing, in accordance with programs stored in the ROM 82. The ROM 82 includes a plurality of storage areas (not shown), including a program storage area. The program storage area stores therein various programs for operating the sewing machine 1. An example of the programs includes a program for executing main processing. The main processing will be described in detail below. The RAM 83 includes a storage area in which results of calculations performed by the CPU 81 is stored.

The flash memory 84 stores therein various parameters for the sewing machine 1 to perform various processing, coordinates (Qnx, Qny), a first target distance Hh, a second target distance Hw, first reference coordinates, second reference coordinates, and pattern data. The coordinates (Qnx, Qny), the first target distance Hh, the second target distance Hw, the first reference coordinates, and the second reference coordinates will be described below. The pattern data is used by the sewing machine 1 to sew available embroidery patterns. The flash memory 84 further stores therein correspondence between the type of embroidery hoop 50 and the sewable range R (refer to FIG. 1). The sewable range R is set, inside the embroidery hoop 50, as a sewable range.

The I/O interface 85 is connected to drive circuits 91-96, the touch screen 26, the start/stop switch 29, the image sensor 57C of the camera 57, the light source 58D of the projector 58, and a detector 35. The detector detects attachment of an embroidery hoop 50 to the moving unit 40 and outputs the detection result depending on the type of embroidery hoop 50. The detector detects the type of embroidery hoop 50 based on a combination of ON and OFF of a plurality of mechanical switches. The light source 58D of the projector 58 turns on by a control signal from the CPU 81. The image sensor 57C of the camera 57 outputs to the CPU 81, upon detecting light, signals indicating an image captured (hereinafter referred to as "a captured image") in a capture area P.

The drive circuit 91 is connected to the machine motor 33. Based on a control signal from the CPU 81, the drive circuit 91 drives the machine motor 33. The driven machine motor 33 drives the needle bar drive mechanism 55 via the shaft 34, thereby moving the needle bar 6 up and down. The drive circuit 92 is connected to a feed amount adjustment motor 22. Based on a control signal from the CPU 81, the drive circuit 92 drives the feed amount adjustment motor 22. The driven feed amount adjustment motor 22 drives the feed dog 24 via the feed mechanism 23 of the sewing machine 1. The drive circuit 93 is connected to the LCD 15. Based on a control signal from the CPU 81, the drive circuit 93 drives the LCD 15 to display an image on the LCD 15. The drive circuit 94 is connected to the X-axis motor 44. The drive circuit 95 is connected to the Y-axis motor 45. Based on a control signal from the CPU 81, the drive circuits 94 and 95 drive the X-axis motor 44 and the Y-axis motor, respectively. The driven X-axis motor 44 and Y-axis motor 45 moves the embroidery hoop 50 attached to the moving unit 40, by a moving amount based on a control signal, in the left-right direction (X-axis direction) and in the front-rear direction (Y-axis direction). The drive circuit 96 is connected to the LCD panel 58C of the projector 58. Based on a control signal from the CPU 81, the drive circuit 96 drives the LCD panel 58C to display an image on the LCD panel 59.

Guarantee Area Q

The position of a maximum area M may vary among sewing machines 1 because of an assembling error of a projector 58 to a bed 11 and because of individual differences among projectors 58. To cope with this situation, as shown in FIG. 3, the specifications of each sewing machine 1 specify a predetermined guarantee area Q. The guarantee area Q is rectangular. The guarantee area Q is guaranteed as an area onto which an image is projected by a projector 58 even when the maximum area M of a sewing machine 1 differs from that of another sewing machine 1. In other words, a projector 58 of each sewing machine 1 is able to project an image onto at least the guarantee area Q. The guarantee area Q is always contained in the maximum area M regardless of an assembling error of a projector 58 and regardless of individual differences among projectors 58. The guarantee area Q contains at least a portion of the needle plate 7 on an upper surface of the bed 11. More specifically, the guarantee area Q contains at least the needle hole 7A in the needle plate 7.

The position of the guarantee area Q is defined relative to the position of the needle hole 7A in the upper surface of the bed 11, and more specifically relative to the position of the needle drop position B on the upper surface of the bed 11. A rear left corner, a rear right corner, a front left corner, and a front right corner of the guarantee area Q are referred to as Q1, Q2, Q3, and Q4, respectively. The corners Q1 through Q4 are collectively referred to as Qn (n is any of 1, 2, 3, or 4). Coordinates representing the position of each corner Qn are determined relative to the needle drop position which is defined as an origin (0, 0, 0) in a three-dimensional coordinate system (hereinafter referred to as "a world coordinate system"). X-axis, Y-axis, and Z-axis directions in the world coordinate system respectively correspond to left-right, front-rear, and up-down directions of the sewing machine 1. Rightward, frontward, and upward directions correspond to positive directions in respective coordinate axes. Leftward, rearward, and downward directions correspond to negative directions in respective coordinate axes. The guarantee area Q is defined on an imaginary plane extending along the upper surface of the bed 11. Thus, Z-coordinates are always zero. Hereinafter, coordinates in the world coordinate system are shown by only an X-coordinate and a Y-coordinate while a Z-coordinate is omitted. For example, coordinates representing the position of each corner Qn are shown as (Qnx, Qny). The coordinates (Qnx, Qny) of the guarantee area Q are stored in the flash memory 84 as values unique to the sewing machine 1.

Overview of Main Processing

Referring to FIGS. 5-8, main processing executed by the CPU 81 will be described. The main processing includes first main processing (refer to FIGS. 5 and 6) and second main processing (refer to FIG. 8). In the first main processing, a target area G to be described later (refer to FIGS. 7A and 7B) is determined so as to contain at least the guarantee area Q and to be greater than the guarantee area Q. In the second main processing (refer to FIG. 8), a workpiece C held by the embroidery hoop 50 is moved such that a center in the left-right direction and in the front-rear direction of the determined target area G coincides with a center in the left-right direction and in the front-rear direction of a sewable range R (refer to FIG. 1) of the embroidery hoop 50. In this state, if the projector 58 is operated to project a pattern image showing an embroidery pattern onto a workpiece C, the pattern image is projected onto the workpiece C at a position where the embroidery pattern is actually to be sewn.

First Main Processing

Figure 5:
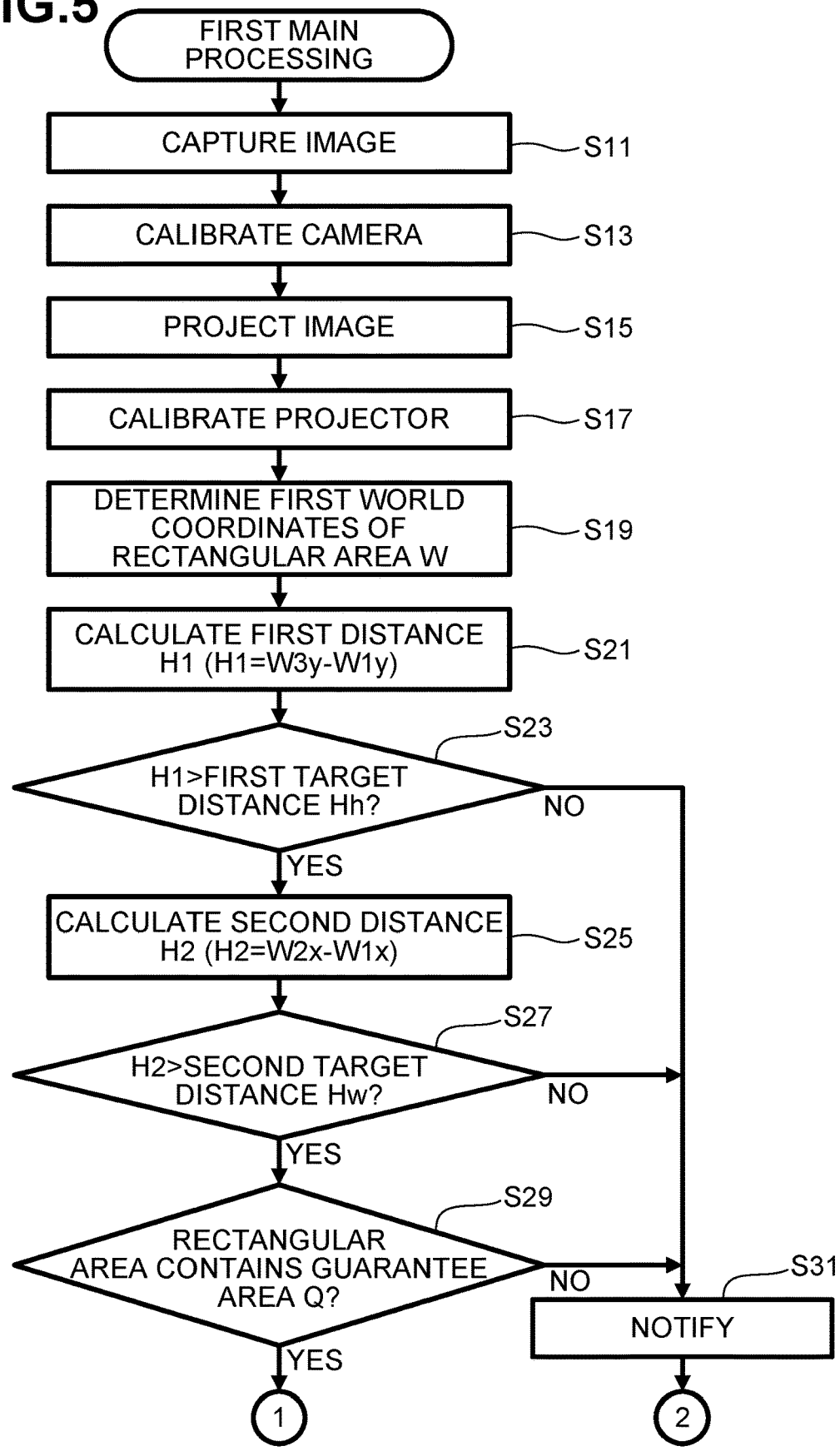
FIG. 5 is a flowchart of part of first main processing.
Figure 6:
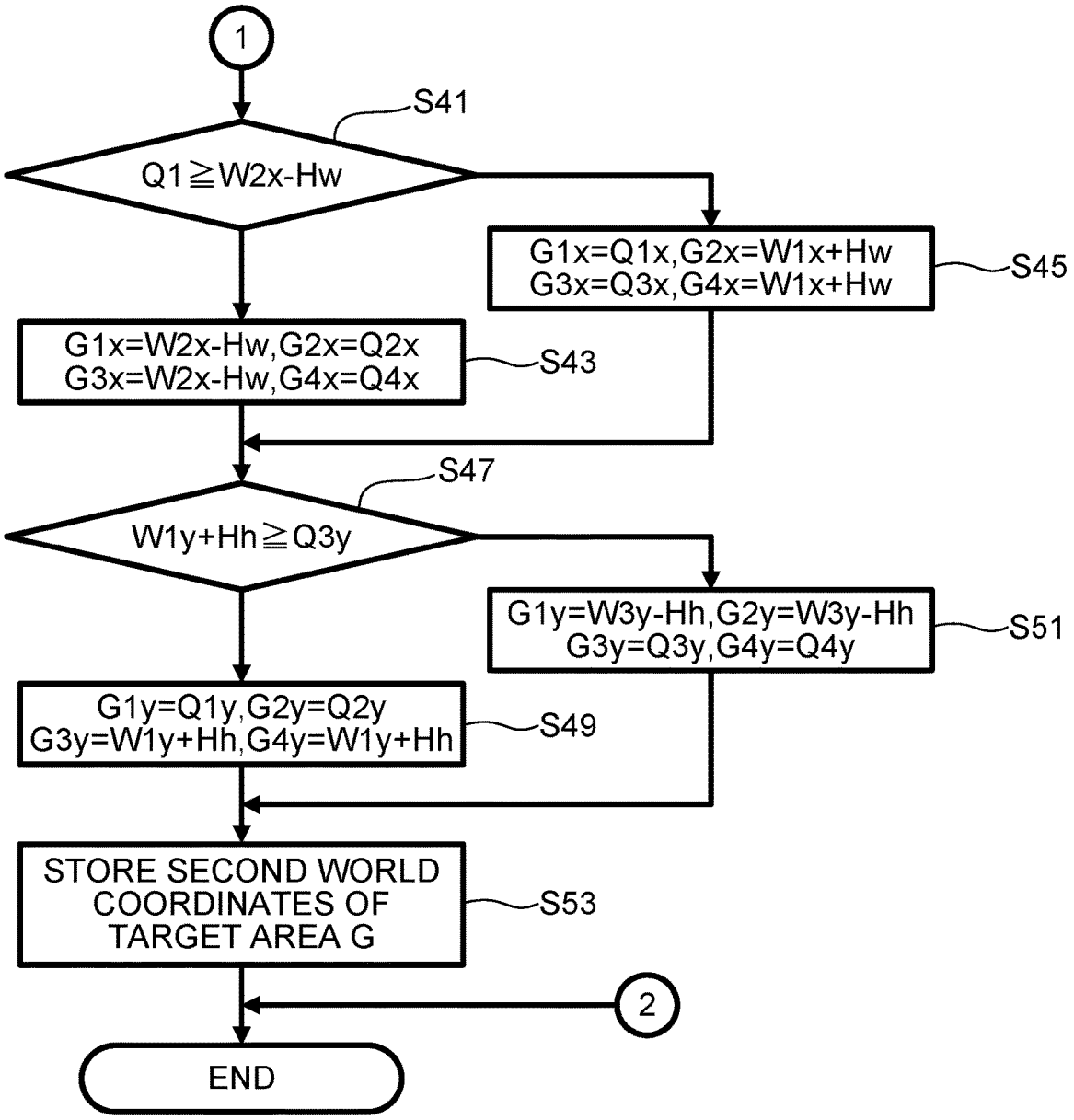
FIG. 6 is a flowchart of the main processing subsequent to the part shown in FIG. 5.

Referring to FIGS. 5 and 6, the first main processing will be described. For example, the first main processing may be executed in a preparatory stage before shipment of the sewing machine 1. The CPU 81 controls the LCD 15 to display thereon a plurality of commands including a start command to start the first main processing. The CPU 81 waits for a panel operation to select the start command. A user removes the moving unit 40 from the bed 11 of the sewing machine 1. Then, the user places a checker board with a predetermined pattern image, at a predetermined position on an upper surface of the bed 11. The pattern image is used as a reference image to determine a world coordinate system. For example, the pattern image may include predetermined (circular or polygonal) patterns arranged repeatedly at regular intervals. Other pattern images than the above may be used. Subsequently, the user selects, through operation of the LCD 15, the start command displayed on the LCD 15. Upon detecting the selection of the start command, the CPU 81 retrieves and executes a program stored in the ROM 82, thereby starting the first main processing.

As shown in FIG. 5, the CPU 81 drives the camera 57 for image capture (S11). The camera 57 captures an image in the capture area P (refer to FIG. 1) and outputs to the CPU 81 signals indicating the captured image. The CPU 81 obtains the captured image (hereinafter referred to as "a second captured image") based on the signals output from the camera 57. The checker board is placed in the capture area P. Thus, the obtained second captured image includes the pattern image of the checker board. The CPU 81 retrieves and obtains the first reference coordinates stored in the flash memory 84. The first reference coordinates are reference coordinates representing the pattern image in the world coordinate system.

The CPU 81 executes camera calibration as described below (S13). The CPU 81 determines, based on the second captured image, coordinates representing the position of the pattern image in a coordinate system unique to the camera 57 (hereinafter referred to as "a camera coordinate system"). The CPU 81 determines, based on the relationship between the determined coordinates and the first reference coordinates, a first transformation matrix for transforming the camera coordinate system to the world coordinate system. The CPU 81 stores the determined first transformation matrix in the RAM 83. The first transformation matrix allows the capture area P of the camera 57 to be represented in the world coordinate system.

After completion of the camera calibration, the user removes the checker board from the bed 11 of the sewing machine 1. The CPU 81 drives the projector 58 and causes the LCD panel 58D to display thereon an image to be projected onto the maximum area M. Then, the CPU 81 turns on the light source 58D such that image light beams are emitted from the projector 58 and the image is projected onto the maximum area M (S15). A projection area of the projected image coincides with the maximum area M.

The CPU 81 executes projector calibration as described below (S17). The CPU 81 drives the camera 57 for image capture. The camera 57 captures the image projected onto the maximum area M in the capture area P. The camera 57 outputs to the CPU 81 signals indicating the captured image. The CPU 81 obtains the captured image (hereinafter referred to as "a first captured image") based on the signals output from the camera 57. The obtained first captured image includes the projected image indicating the maximum area M. The CPU 81 retrieves and obtains the second reference coordinates stored in the flash memory 84. The second reference coordinates are reference coordinates representing the maximum area M in a coordinate system unique to the projector 58 (hereinafter referred to as 37 a projector coordinate system).

The CPU 81 determines, based on the first captured image, coordinates representing the position of the maximum area M in the camera coordinate system. The CPU 81 determines, based on the relationship between the determined coordinates and the obtained second reference coordinates, a second transformation matrix for transforming the projector coordinate system to the camera coordinate system. The CPU 81 determines, based on the first transformation matrix and the second transformation matrix, a third transformation matrix for transforming the projector coordinate system to the world coordinate system. The CPU 81 stores the determined third transformation matrix in the RAM 83. The third transformation matrix allows the maximum area M of the projector 58 to be represented in the world coordinate system.

Figures 7A, 7B:
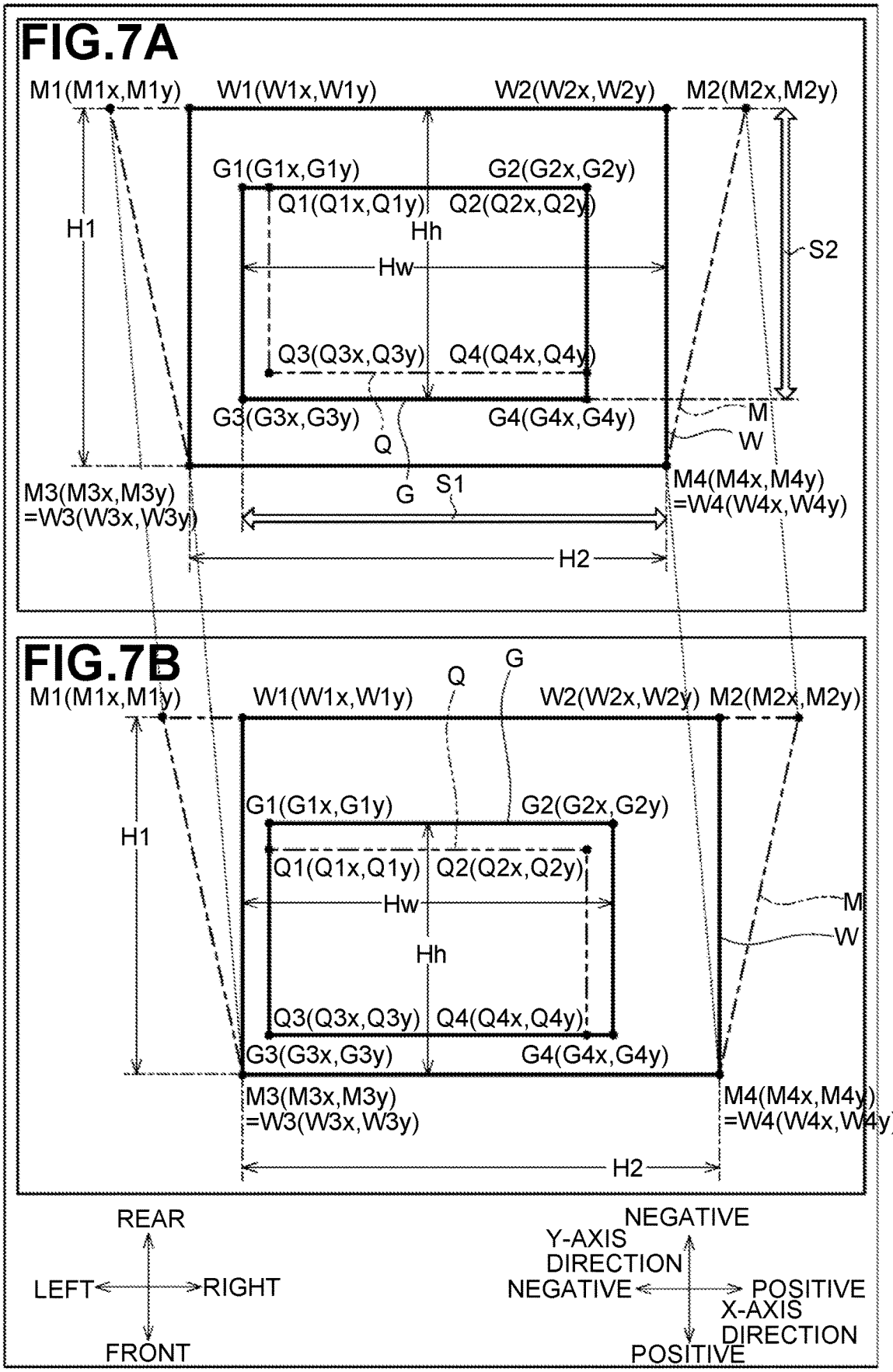
FIGS. 7A and 7B are diagrams illustrating a method for determining a target area.

The CPU 81 determines a rectangular area W from the maximum area M (S19) as described below to determine the target area G which is rectangular and contains the guarantee area Q. As shown in FIGS. 7A and 7B, the rectangular area W is a rectangular area contained in the maximum area M. A rear left corner, a rear right corner, a front left corner, and a front right corner of the maximum area M are referred to as M1, M2, M3, and M4, respectively. The corners M1 through M4 are collectively referred to as Mn. A rear left corner, a rear right corner, a front left corner, and a front right corner of the rectangular area W are referred to as W1, W2, W3, and W4, respectively. The corners W1 through W4 are collectively referred to as Wn.

Coordinates of the position of each corner Wn of the rectangular area W which are represented in the world coordinate system are determined based on the position of each corner Mn of the maximum area M, as described below. First, the CPU 81 determines, based on the first captured image obtained during the projector calibration (refer to S17), coordinates representing, in the camera coordinate system, the position of each corner Mn of the maximum area M indicated by the image projected by the projector 58. The CPU 81 applies the third transformation matrix to the determined coordinates to determine coordinates (Mnx, Mny) representing in the world coordinate system, the position of each corner Mn of the maximum area M.

Then, the CPU 81 determines, based on the determined coordinates (Mnx, Mny), coordinates (Wnx, Wny) representing, in the world coordinate system, the position of each corner Wn of the rectangular area W, as shown below.

$W1x=M3x$, $W2x=M4x$, $W3x=M3x$, $W4x=M4x$ $W1y=M1y$, $W2y=M2y$, $W3y=M3y$, $W4y=M4y$

As shown in FIGS. 7A and 7B, the corners W3 and W4 of the rectangular area W are equal in position to the corners M3 and M4 of the maximum area M, respectively. The corner W1 of the rectangular area W is located at an intersection between a straight line extending in the negative direction along the Y-axis from the corner W3, and a side M1-M2 connecting the corners M1 and M2. The corner W2 of the rectangular area W is located at an intersection between a straight line extending in the negative direction along the Y-axis from the corner W4, and a side M1-M2. Hereinafter, the determined coordinates (Wnx, Wny) are referred to as "first world coordinates".

As shown in FIG. 5, the CPU 81 calculates a distance in the Y-axis direction of the rectangular area W as a first distance H1 (S21). More specifically, the CPU calculates the first distance H1 by subtracting Y-coordinate W1*y* indicating the position of the corner W1 in the Y-axis direction from the Y-coordinate W3*y* indicating the position of the corner W3 in the Y-axis direction (S21). The CPU 81 determines whether the calculated first distance H1 is greater than a first target distance Hh to determine whether the target area G falls within the rectangular area W in the Y-axis direction. The first target distance Hh is a predetermined value indicating a minimum distance in the Y-axis direction of the target area G, and is previously stored in the flash memory 84. When the first distance H1 is not greater than the target distance Hh, the target area G does not fall within the rectangular area W in the Y-axis direction. A portion of the target area G is out of the rectangular area W in the Y-axis direction. When the CPU 81 determines that the first distance H1 is not greater than the first target distance Hh (S23: NO), the processing goes to step S31. The CPU 81 controls the LCD 15 to display thereon a screen informing that it is impossible to set the target area G (S31). The CPU 81 ends the first main processing (refer to FIG. 6).

In contrast, when the first distance H1 is greater than the first target distance Hh, the target area G falls within the rectangular area W in the Y-axis direction. When the CPU 81 determines that the first distance H1 is greater than the first target distance Hh (S23: YES), the processing goes to step S25. The CPU 81 calculates an X-axis distance of the rectangular area W as a second distance H2 (S25). More specifically, the CPU calculates the second distance H2 by subtracting X-coordinate W1$x$ indicating the position of the corner W1 in the X-axis direction from the X-coordinate W2$x$ indicating the position of the corner W2 in the X-axis direction (S25). The CPU 81 determines whether the calculated second distance H2 is greater than a second target distance Hw to determine whether the target area G falls within the rectangular area W in the X-axis direction. The second target distance Hw is a predetermined value indicating a minimum distance in the X-axis direction of the target area G, and is previously stored in the flash memory 84. When the first distance H2 is not greater than the target distance Hw, the target area G does not fall within the rectangular area W in the X-axis direction. A portion of the target area G is out of the rectangular area W in the X-axis direction. When the CPU 81 determines that the second distance H2 is not greater than the second target distance Hw (S27: NO), the processing goes to step S31. The CPU 81 controls the LCD 15 to display thereon a screen informing that it is impossible to set the target area G (S31). The CPU 81 ends the first main processing (refer to FIG. 6).

In contrast, when the second distance H2 is greater than the second target distance Hw, the target area G falls within the rectangular area W in the X-axis direction and in the Y-axis direction. The CPU 81 determines whether the rectangular area W contains the guarantee area Q (S29). When at least one of the following conditions is not satisfied, the CPU 81 determines that the rectangular area W does not contain the guarantee area Q (S29: NO).

$W1x \leq Q1x$, $W2x \geq Q2x$, $W3x \leq Q3x$, $W4x \geq Q4x$, $W1y \leq Q1y$, $W2y \leq Q2y$, $W3y \geq Q3y$, $W4y \geq Q4y$ In this case, the processing goes to step S31. The CPU 81 controls the LCD 15 to display thereon a screen notifying that it is impossible to set the target area G (S31). The CPU 81 ends the first main processing (refer to FIG. 6).

In contrast, when all of the above conditions are satisfied, the CPU 81 determines that the rectangular area W contains the guarantee area Q (S29: YES). In this case, the processing goes to step S41 (refer to FIG. 6). As shown in FIG. 6, the CPU 81 determines, based on the first world coordinates (Wnx, Wny) of the rectangular area W determined in step S19 (refer to FIG. 5), coordinates (hereinafter referred to as "second world coordinates") representing, in the world coordinate system, the target area G containing at least the guarantee area Q (S41-S51). Hereinafter, as shown in FIGS. 7A and 7B, a rear left corner, a rear right corner, a front left corner, and a front right corner of the target area G are referred to as G1, G2, G3, and G4, respectively. The corners G1 through G4 are collectively referred to as Gn. The second world coordinates of each corner Gn are shown as (Gnx, Gny).

As shown in FIG. 6, the CPU 81 determines whether the corner Q1 of the guarantee area Q is located, in the X-axis direction, within a range S1 (refer to FIG. 7A) which is between the corner W2 of the rectangular area W and a position away by a distance Hw from the corner W2 in the negative X-axis direction. When the first world coordinate Q1$x$ of the corner Q1 in the X-axis direction is greater than or equal to W2$x$-Hw, the CPU 81 determines that the corner Q1 is located within the range S1 in the X-axis direction (S41: YES). In this case, the CPU 81 determines the second world coordinates G1$x$, G2$x$, G3$x$, and G4$x$ in the X-axis direction in step S43 as shown below and in FIG. 7A (S43).

$G1x = W2x - Hw$, $G2x = Q2x$, $G3x = W2x - Hw$, $G4x = Q4x$

In contrast, when the first world coordinate Q1$x$ of the corner Q1 in the X-axis direction is less than W2$x$–Hw, the CPU 81 determines that the corner Q1 is not located within the range S1 in the X-axis direction (S41: NO). In this case, the CPU 81 determines the second world coordinates G1$x$, G2$x$, G3$x$, and G4$x$ in the X-axis direction, as shown below and in FIG. 7B (S45).

$G1x = Q1x$, $G2x = W1x + Hw$, $G3x = Q3x$, $G4x = W1x + Hw$

The CPU 81 determines whether the corner Q3 of the guarantee area Q is located, in the Y-axis, within a range S2 (refer to FIG. 7A) which is between the corner W1 of the rectangular area W and a position away by the first target distance Hh from the corner W1 in the positive Y-axis direction (S47). When the first world coordinate Q3$y$ of the corner Q3 in the Y-axis direction is less than or equal to W1$y$+Hh, the CPU 81 determines that the corner Q3 is located within the range S2 in the Y-axis direction (S47: YES). In this case, the CPU 81 determines the second world coordinates G1$y$, G2$y$, G3$y$, and G4$y$ in the Y-axis direction, as shown below and in FIG. 7A (S49).

$G1y = Q1y$, $G2y = Q2y$, $G3y = W1y + Hh$, $G4y = W1y + Hh$

In contrast, when the first world coordinate Q3$y$ of the corner Q3 in the Y-axis direction is greater than W1$y$+Hh, the CPU 81 determines that the corner Q3 is not located within the range S2 in the Y-axis direction (S47: NO). In this case, the CPU 81 determines the second world coordinates G1$y$, G2$y$, G3$y$, and G4$y$ in the Y-axis direction, as shown below and in FIG. 7B (S51).

$G1y = W3y - Hh$, $G2y = W3y - Hh$, $G3y = Q3y$, $G4y = Q4y$

For example, in a case shown in FIG. 7A, a side G1-G2 (hereinafter referred to as "a first target-area side G1-G2") between the corners G1 and G2 of the target area G is located to overlap and extend along a side Q1-Q2 (hereinafter referred to as "a first guarantee-area side Q1-Q2") between the corners Q1 and Q2 of the guarantee area Q. A side G2-G4 (hereinafter referred to as "a second target-area side G2-G4") between the corners G2 and G4 of the target area G is connected to a right end of the first target-area side G1-G2. A side Q2-Q4 (hereinafter referred to as "a second guarantee-area side Q2-Q4") between the corners Q2 and Q4 of the guarantee area Q is connected to a right end of the first guarantee-area side Q1-Q2. The second target-area side G2-G4 is located to overlap and extend along the second guarantee-area side Q2-Q2.

A side W1-W2 (hereinafter referred to as "a first rectangular-area side W1-W2") of the rectangular area W is adjacent to and offset in the negative Y-direction (upward) from the first guarantee-area side Q1-Q2 of the guarantee area Q. A side W3-W4 (hereinafter referred to as "a second rectangular-area side W3-W4") of the rectangular area W is opposite to the first rectangular-area side W1-W2. A side G3-G4 (hereinafter referred to as "a third target-area side G3-G4") between the corners G3 and G4 of the target area G is opposite to the first target-area side G1-G2. The third target-area side G3-G4 is located away by the first target distance Hh from the first rectangular-area side W1-W2 toward the second rectangular-area side W3-W4.

A side W2-W4 (hereinafter referred to as "a third rectangular-area side W2-W4") of the rectangular area W is adjacent to and offset in the positive X-direction (rightward) from the second guarantee-area side Q2-Q4 of the guarantee area Q. A side W1-W3 (hereinafter referred to as "a fourth rectangular-area side W1-W3") of the rectangular area W is opposite to the third rectangular-area side W2-W4. A side G1-G3 (hereinafter referred to as "a fourth target-area side G1-G3") between the corners G1 and G3 of the target area G is opposite to the second target-area side G2-G4. The fourth target-area side G1-G3 is located away by the second target distance Hw from the third rectangular-area side W2-W4 toward the fourth rectangular-area side W1-W3.

For example, in a case shown in FIG. 7B, a side G3-G4 (hereinafter referred to as "a first target-area side G3-G4") between the corners G3 and G4 of the target area G is located to overlap and extend along a side Q3-Q4 (hereinafter referred to as "a first guarantee-area side Q3-Q4") between the corners Q3 and Q4 of the guarantee area Q. A side G1-G3 (hereinafter referred to as "a second target-area side G1-G3") between the corners G1 and G3 of the target area G is connected to a left end of the first target-area side G3-G4. A side Q1-Q3 (hereinafter referred to as "a second guarantee-area side Q1-Q3") between the corners Q1 and Q3 of the guarantee area Q is connected to a left end of the first guarantee-area side Q3-Q4. The second target side G1-G3 is located to overlap and extend along the second guarantee-area side Q1-Q3.

A side W3-W4 (hereinafter referred to as "a first rectangular-area side W3-W4") of the rectangular area W is adjacent to and offset in the positive Y-axis direction (downward) from the first guarantee-area side Q3-Q4 of the guarantee area Q. A side W1-W2 (hereinafter referred to as "a second rectangular-area side W1-W2") of the rectangular area W is opposite to the first rectangular-area side W3-W4. A side G1-G2 (hereinafter referred to as "a third target-area side G1-G2") between the corners G1 and G2 of the target area G is opposite to the first target-area side G3-G4. The third target-area side G1-G2 is located away by the first target distance Hh from the first rectangular-area side W3-W4 toward the second rectangular-area side W1-W2.

A side W1-W3 (hereinafter referred to as "a third rectangular-area side W1-W3") of the rectangular area W is adjacent to and offset in the negative X-axis direction (leftward) from the second guarantee-area side Q1-Q3 of the guarantee area Q. A side W2-W4 (hereinafter referred to as "a fourth rectangular-area side W2-W4") of the rectangular area W is opposite to the third rectangular-area side W1-W3. A side G2-G4 (hereinafter referred to as "a fourth target-area side G2-G4") between the corners G2 and G4 of the target area G is opposite to the second target-area side G1-G3. The fourth target-area side G2-G4 is located away by the second target distance Hw from the third rectangular-area side W1-W3 toward the fourth rectangular-area side W2-W4.

The CPU 81 stores, in the flash memory 84 (S53), the second world coordinates (Gnx, Gny) determined in the processing in steps S43, S45, S49, and S51. The CPU 81 ends the first main processing.

Second Main Processing

Figure 8:
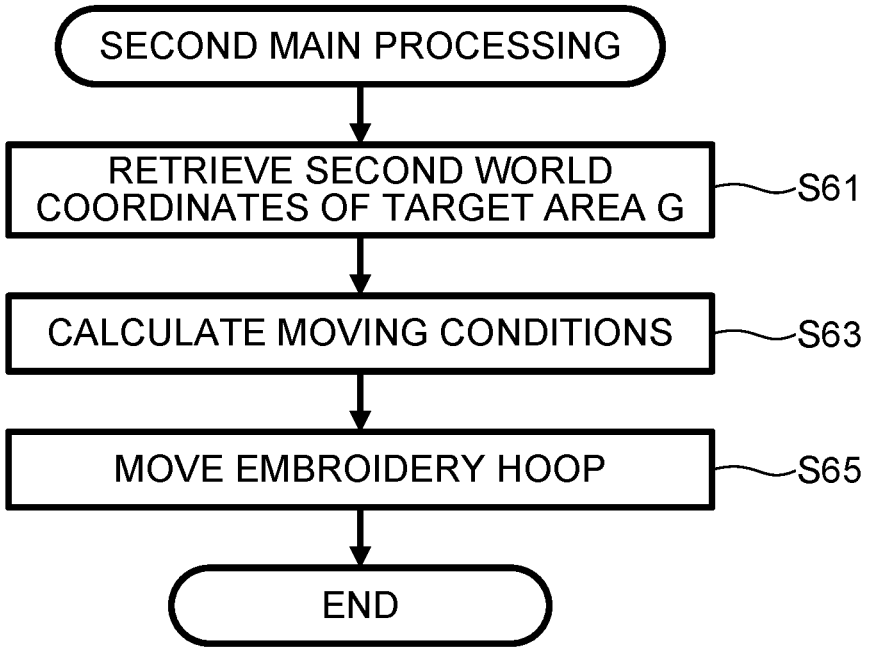
FIG. 8 is a flowchart of second main processing.

Referring to FIG. 8, second main processing will be described. For example, the CPU 81 controls the LCD 15 to display a plurality of pattern images showing embroidery patterns. The CPU 81 waits for a panel operation to select a pattern image. A user selects, through a panel operation, a pattern image desired to be projected by the projector 58. Upon detecting the selection of the pattern image, the CPU 81 retrieves and executes a program stored in the ROM 82, thereby starting the second main processing.

As shown in FIG. 8, the CPU 81 retrieves, in step S61, the second world coordinates (Gnx, Gny) stored in the flash memory 84 in step S53 (refer to FIG. 6) during the first main processing. The CPU 81 determines the position of the target area G, based on the retrieved second world coordinates (Gnx, Gny). The CPU 81 determines the type of an embroidery hoop 50 attached to the moving unit 40, based on a signal output from the detector 35 (refer to FIG. 4).

The CPU 81 determines a sewable range R (refer to FIG. 1) corresponding to the determined type of the embroidery hoop 50 by referring to the information stored in the flash memory 84. The CPU 81 calculates moving conditions, e.g., moving amounts in the X-axis and Y-axis directions of the embroidery hoop 50 such that the center of the determined sewable range R (refer to FIG. 1) coincides with the center of the determined target area G (S63). The CPU 81 drives the X-axis motor 44 and the Y-axis motor 45 (refer to FIG. 4) of the moving unit 40, based on the determined moving conditions. Thus, the embroidery hoop 50 is moved (S65), and the center of the target area G coincides with the center of a workpiece C held by the embroidery hoop 50. The CPU 81 ends the second main processing.

Operation and Effects

The sewing machine 1 determines the first world coordinates (Wnx, Wny) representing the rectangular area W in the world coordinate system (S19). The sewing machine 1 further determines, based on the determined first world coordinates (Wnx, Wny), the second world coordinates (Gnx, Gny) representing the target area G in the world coordinate system (S41-S51), and stores the determined second world coordinates (Gnx, Gny) in the flash memory (S53). The sewing machine 1 is allowed to determine the target area G based on the second world coordinates (Gnx, Gny) stored in the flash memory 84.

The sewing machine 1 is operable with the moving unit 40 attached thereto. The moving unit 20 moves the embroidery hoop 50 holding a workpiece C. The sewing machine 1 drives the moving unit 40 based on the second world coordinates (Gnx, Gny) stored in step S53, thereby moving the embroidery hoop 50 holding the workpiece C to a position where the center of the target area G coincides with the center of a sewable range R in the embroidery hoop 50 (S65). The target area G contains the guarantee area Q onto which the projector 58 projects an image. The center of the sewable range R corresponds to a position at which the sewing machine 1 starts sewing an embroidery pattern on the workpiece C held by the embroidery hoop. When the workpiece C is moved as described above in the sewing machine 1, the projector 58 is allowed to project an image showing an embroidery pattern onto the workpiece C at a position where the embroidery pattern is actually to be sewn.

The guarantee area Q contains at least a portion of the needle plate 7 on the bed 11. In this case, in the sewing machine 1, the projector 58 is allowed to project an image onto an area containing at least the portion of the needle plate 7. The guarantee area Q contains at least the needle hole 7 formed in the bed 11. In this case, in the sewing machine 1, the projector 58 is allowed to project an image onto an area containing at least the needle hole 7A.

In order to determine the third transformation matrix for transforming the projector coordinate system to the world coordinate system, the sewing machine 1 is required to determine, in the world coordinate system, the position of an area (the maximum area M or the rectangular area W) onto which the projector 58 projects an image. As an example for this purpose, providing a sensor on the bed 11 in the sewing machine 1 is conceivable to detect the positions of corners of the maximum area M designated by a user. In contrast, in the above-described embodiment, the sewing machine 1 includes the camera 57 configured to capture an image in the capture area P which contains the maximum area M. The camera 57 captures an image of the checker board placed at the predetermined position in the capture area P (S11). During the camera calibration (S13), the sewing machine 1 determines the first transformation matrix for transforming the camera coordinate system to the world coordinate system. The first transformation matrix transforms the capture area P into the world coordinate system. During the subsequent projector calibration (S17), the CPU 81 determines, using the determined first transformation matrix, the third transformation matrix for transforming the projector coordinate system to the world coordinate system. The sewing machine 1 determines the third transformation matrix without the use of a sensor nor the intervention of a user. The sewing machine 1 determines, using the determined third transformation matrix, the second world coordinates (Gnx, Gny) of the target area G.

During the projector calibration (S17), the sewing machine 1 determines the coordinates representing the position of the maximum area M in the camera coordinate system, based on the first captured image captured by the camera 57. The sewing machine 1 determines, based on the determined coordinates, the second transformation matrix for transforming the projector coordinate system to the camera coordinate system. The sewing machine 1 further determines, based on the first transformation matrix and the second transformation matrix, the third transformation matrix for transforming the projector coordinate system to the world coordinate system. Thus, the sewing machine 1 determines, using the determined third transformation matrix, the second world coordinates (Gnx, Gny) of the target area G.

The position of the guarantee area Q is determined relative to the needle drop position B on the bed 11. The sewing machine 1 determines the guarantee area Q accurately by obtaining the needle drop position.

The sewing machine 1 determines the target area G based on the positions of the sides of the rectangular area W and the guarantee area Q (S41-S51). By doing so, the sewing machine 1 properly determines the guarantee area G which is contained in the rectangular area W and contains the guarantee area Q.

Upon determining that the target area G is not contained in the rectangular area W (S23: NO, S27: NO), the sewing machine 1 displays on the LCD 15 a screen notifying the user to that effect (S31).

Modifications

While the disclosure has been described with reference to the specific embodiment, various changes and modifications may be applied therein without departing from the spirit and scope of the disclosure. In the above-described embodiment, the world coordinate system is used as an example of a real space coordinate system. A real space coordinate system is a coordinate system indicating positions in a real space. However, any coordinate system may be used as long as it determines coordinates representing at least two-dimensional positions in X-axis and Y-axis directions in a real space. Instead of the Cartesian coordinate system in the above-described embodiment, a polar coordinate system may be used as a coordinate system indicating two-dimensional positions.

The CPU 81 determines, as the rectangular area W, the maximum rectangular area contained in the maximum area M. However, the rectangular area W may not be the maximum rectangular area contained in the maximum area M. The area determined in step S19 may be a rectangular area contained in the maximum area M, other than the maximum rectangular area. The projector 58 is not limited to the LCD projector. A cathode ray tube (CRT) projector and a digital light processing (DLP) projector may be used. A storage medium storing the second world coordinates (Gnx, Gny) is not limited to the flash memory 84. The second world coordinates may be stored in a storage medium such as a USB memory.

The guarantee area Q may be defined as an area not containing the needle plate 7 on the bed 11. The guarantee area Q may be defined as an area not containing the needle hole 7A in the needle plate 7.

The CPU 81 may not execute camera calibration (S13) or projector calibration (S17). In this case, a sensor such as a touch screen may be provided on the bed 11 of the sewing machine 1. The user may designate, via the sensor, the positions of the corners of the maximum area M projected by the projector 58. The CPU 81 may directly determine the second world coordinates (Gnx, Gny) of the rectangular area W, based on the designated positions of the corners of the maximum area M. In this case, the sewing machine 1 may not include the camera 57.

The CPU 81 may determine the position of the needle drop position B from an image captured by the camera 57. The CPU 81 may determine the guarantee area Q relative to the position of the determined needle drop position B. The guarantee area Q may be determined relative to a reference position (e.g. the position of a mark previously provided on the needle plate 7), instead of the needle drop position B.

In the above-described embodiment, the second world coordinates (Gnx, Gny) stored in the flash memory 84 during the first main processing are referred to in the step for moving the workpiece C during the second main processing. The second world coordinates (Gnx, Gny) stored in the flash memory 84 may be referred to in other processing. For example, the CPU 81 may control the projector 58 to project an image including selection buttons. The CPU 81 may control the camera 57 to capture the position of a finger of the user pointing to a desired selection button. The CPU 81 may determine, in the world coordinate system, the coordinates representing the position of the finger included in the captured image, based on the second world coordinates (Gnx, Gny). The CPU 81 may determine the selection button located at the determined coordinates and execute processing accordingly.

A method for determining the target area G from the rectangular area W is not limited to the above-described method. For example, the CPU 81 may determine, as the target area G, an area formed by moving each side of the rectangular area W inward by a predetermined distance at a time.

A method of notifying that the target area G is not contained in the rectangular area W (S23: NO, S27: NO) is not limited to the above-described method. For example, the CPU 81 may notify by outputting an alarm from a speaker provided in the sewing machine 1. Upon determining that the target area G is not contained in the rectangular area W (S23: NO, S27: NO), the CPU 81 may end the first main processing without notifying the user.

There is a case where the projector 58 is specified by the product specifications or by a fixing method such that at least the target area G is contained in the rectangular area W. In this case, the CPU 81 may not determine whether the target area G is contained in the rectangular area W (S23, S27).

Others

The elements in the above-described embodiment correspond to elements of a sewing machine according to an aspect of the disclosure, as below. The projector 58 is an example of a projector. The CPU 81 executing step S15 is an example of a controller controlling a projector. The CPU 81 executing step S19 is an example of the controller determining first world coordinates. The CPU 81 executing steps S41-S51 is an example of the controller determining second world coordinates. The flash memory 84 is an example of a storage medium. The CPU 81 executing step S53 is an example of the controller storing the second world coordinates. The camera 57 is an example of a capture unit. The third transformation matrix is an example of a first parameter. The CPU 81 executing step S17 is an example of the controller determining the first parameter. The first transformation matrix is an example of a second parameter. The CPU 81 executing step S13 is an example of the controller determining the second parameter. The CPU 81 executing steps S23 and S27 is an example of the controller determining. The CPU 81 executing step S31 is an example of the controller notifying. The CPU 81 executing step S65 is an example of the controller controlling a moving unit.

What is claimed is:

1. A sewing machine comprising:

a bed;

a projector configured to project an image toward the bed onto at least a guarantee area;

a storage medium; and a controller configured to:

control the projector to project the image toward the bed onto a maximum area;

determine, based on a position of the image projected onto the maximum area, first world coordinates representing, in a real space coordinate system, a rectangular area contained in the maximum area;

determine, based on the first world coordinates, second world coordinates representing, in the real space coordinate system, a target area containing at least the guarantee area; and store the second world coordinates in the storage medium.

2. The sewing machine according to claim 1, wherein the bed includes a needle plate, and the guarantee area contains at least a portion of the needle plate.

3. The sewing machine according to claim 1, wherein the bed has a needle hole, and the guarantee area contains at least the needle hole.

4. The sewing machine according to claim 1, further comprising a capture unit configured to capture an image of a capture area, wherein the controller is configured to:

control the capture unit to capture, as a first captured image, the image projected by the projector onto the maximum area; and determine, based on the first captured image, a first parameter for indicating the maximum area in the real space coordinate system, wherein the first world coordinates are determined based on the position of the image projected onto the maximum area and the first parameter.

5. The sewing machine according to claim 4, wherein the controller is configured to:

control the capture unit to capture, as a second captured image, a reference image to determine the real space coordinate system; and determine, based on the second captured image, a second parameter for indicating the capture area in the real space coordinate system, wherein the first parameter for indicating the maximum area in the real space coordinate system is determined based on the second parameter.

6. The sewing machine according to claim 1, further comprising a sewing needle configured to move down to a needle drop position on the bed, wherein the guarantee area is defined relative to the needle drop position.

7. The sewing machine according to claim 1, wherein the target area is rectangular and has first, second, third, and fourth target-area sides, and the guarantee area is rectangular and has first, second third, and four guarantee-area sides, and the rectangular area has first, second, third, and fourth rectangular-area sides, and wherein the controller is configured to determine the second world coordinates based on the first world coordinates by:

determining the first target-area side so as to overlap and extend along the first guarantee-area side;

determining the second target-area side connected to an end of the first target-area side, so as to overlap and extend along the second guarantee-area side connected to an end of the first guarantee-area side;

determining the third target-area side opposite to the first target-area side, so as to be located at a position away by a first distance from the first rectangular-area side adjacent to the first guarantee area side, toward the second rectangular-area side opposite to the first rectangular-area side; and determining the fourth target-area side opposite to the second target-area side, so as to be located at a position away by a second distance from the third rectangular-area side adjacent to the second guarantee-area side, toward the fourth rectangular-area side opposite to the third rectangular-area side.

8. The sewing machine according to claim 1, further comprising a moving unit configured to move an embroidery hoop for holding a workpiece, wherein the controller controls the moving unit to move the embroidery hoop, based on the second world coordinates stored in the storage medium, such that a center of the target area coincides with a center of a sewable range in the embroidery hoop.

9. The sewing machine according to claim 1, wherein the controller is configured to:

determine whether the target area is contained in the rectangular area; and upon determining that the target area is not contained in the rectangular area, notify of the determination, wherein the second world coordinates are determined upon determination that the target area is contained in the rectangular area.

* * * * *